US006041732A

United States Patent [19]

Ikeda

[11] Patent Number: 6,041,732

[45] **Date of Patent: *Mar. 28, 2000**

[54] SEAT ASSEMBLY FOR WATERCRAFT

[75] Inventor: Keijiro Ikeda, Shizuoka, Japan

[73] Assignee: Yamaha Hatsudoki Kabushiki Kaisha, Japan

[ * ] Notice: This patent is subject to a terminal disclaimer.

[21] Appl. No.: 08/896,997

[22] Filed: Jul. 21, 1997

[30] Foreign Application Priority Data

Jul. 19, 1996 [JP] Japan ..... 8-190900

[51] Int. Cl.[7] ..... B63B 17/00

[52] U.S. Cl. ..... 114/363; 114/55.57

[58] Field of Search ..... 114/270, 362, 114/363; 297/195.2, 195.11–195.13, 215.1, 215.11–215.15

[56] References Cited

U.S. PATENT DOCUMENTS

| | | | |
|---|---|---|---|
| Re. 34,922 | 5/1995 | Hattori et al. . | |
| 3,483,844 | 12/1969 | Trautwein . | |
| 3,485,527 | 12/1969 | Barghout . | |
| 4,318,700 | 3/1982 | Price . | |
| 4,411,214 | 10/1983 | Horiuchi . | |
| 4,625,986 | 12/1986 | Kassai . | |
| 4,673,212 | 6/1987 | Mayer . | |
| 4,688,509 | 8/1987 | Nishida | 114/270 |
| 5,255,626 | 10/1993 | Hattori et al. . | |
| 5,320,059 | 6/1994 | Ikeda . | |
| 5,372,082 | 12/1994 | Hattori . | |
| 5,406,904 | 4/1995 | Kobayashi . | |
| 5,537,948 | 7/1996 | Kobayashi . | |
| 5,544,937 | 8/1996 | Hanagan . | |
| 5,676,086 | 10/1997 | Watkins | 114/270 |

*Primary Examiner*—Ed Swinehart
*Attorney, Agent, or Firm*—Knobbe, Martens, Olson & Bear, LLP

[57] ABSTRACT

An improved watercraft and seat design increases the ability of the rider of a small watercraft to maintain his or her position in the watercraft while sitting in a rearward facing direction. The watercraft includes a contoured seat having a protrusion that divides the seat into forward and rearward seat sections. Upwardly inclined surfaces on the protrusion inhibit movement of the riders on the seat in either forward or rearward directions. The seat also includes a roughened upper surface texture with generally smooth surface textures on the sides of the seat. This provides additional traction to the seated rider without irritating or chafing the rider's legs. Handles are also provided for the rider's use, when seated in both a forward-facing and a rearward-facing direction.

14 Claims, 3 Drawing Sheets

SEAT ASSEMBLY FOR WATERCRAFT

FIELD OF THE INVENTION

This invention relates to the field of small watercraft and, more particularly, to an improved seat for use on a small watercraft.

DESCRIPTION OF RELATED ART

Personal watercraft have become popular in recent years. This type of watercraft is sporting in nature; it turns swiftly, is easily maneuverable, and accelerates quickly. A personal watercraft today commonly carries one rider and possibly one or two passengers. A relatively small hull of the personal watercraft, comprising an upper deck and a lower hull, commonly defines a riders' area above an engine compartment. An internal combustion engine frequently powers a jet propulsion unit in a tunnel formed on the underside of the watercraft hull, which propulsion unit propels the watercraft. The engine lies within the engine compartment, below the riders' area. The engine is generally accessed by removal of a panel in the hull, which is typically part of the riders' seat.

While originally designed for the recreational use of a single rider, personal watercraft have increased in size and versatility and are currently used in many diverse areas other than personal recreation such as lifeguard rescue, public safety and military uses, among others. However, the predominant use of these small watercraft remains recreational.

SUMMARY OF THE PRESENT INVENTION

Small watercraft, such as for example, personal watercraft, have now become powerful enough to be used as towing vehicles for water skiers. However, common sense, as well as various laws and regulations, dictate that all water skiing tow vehicles must carry at least two persons, one who is operating the towing vehicle while the other maintains a constant watch on the water skier. This allows the driver of the tow vehicle to maintain an adequate lookout to ensure safe operation of the towing vehicle, while simultaneously allowing the second rider to closely observe the water skier to ensure safety of the skier. Prior personal watercraft, however, have not provided a seat which is specifically designed to observe the water skier behind the watercraft. A need therefore exists for a straddle-type seat with at least one section that allows a passenger of a small watercraft to sit comfortably in a rearward facing position while inhibiting the passenger from sliding forward on the seat.

In accordance with one aspect of the present invention, there is provided an improved watercraft and seat design for carrying a plurality of riders in the watercraft. The seat comprises a forward seat section located towards a bow of the small watercraft and a rearward seat section located towards a stem of the watercraft. A protrusion extends upwardly between the forward and rearward seat sections. The protrusion has an inclined front surface which is located toward the bow and smoothly rises from the forward seat section toward the rear of the watercraft. The protrusion also includes an inclined rear surface being located toward the stern and is distanced from the front surface along a longitudinal axis of the seat. The front surface has a sufficient height relative to the forward seat section to inhibit forward sliding of a forward facing rider seated in the forward seat section of the seat. The rear surface also has a sufficient height relative to the rearward seat section to inhibit forward sliding of a rearward facing rider seated in the rearward seat section of the seat.

Further aspects, features and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment is intended to illustrate, but not to limit the invention. The drawings contain the following figures.

DETAILED DESCRIPTION OF THE PREFERRED EMBODIMENT

Figure 1:
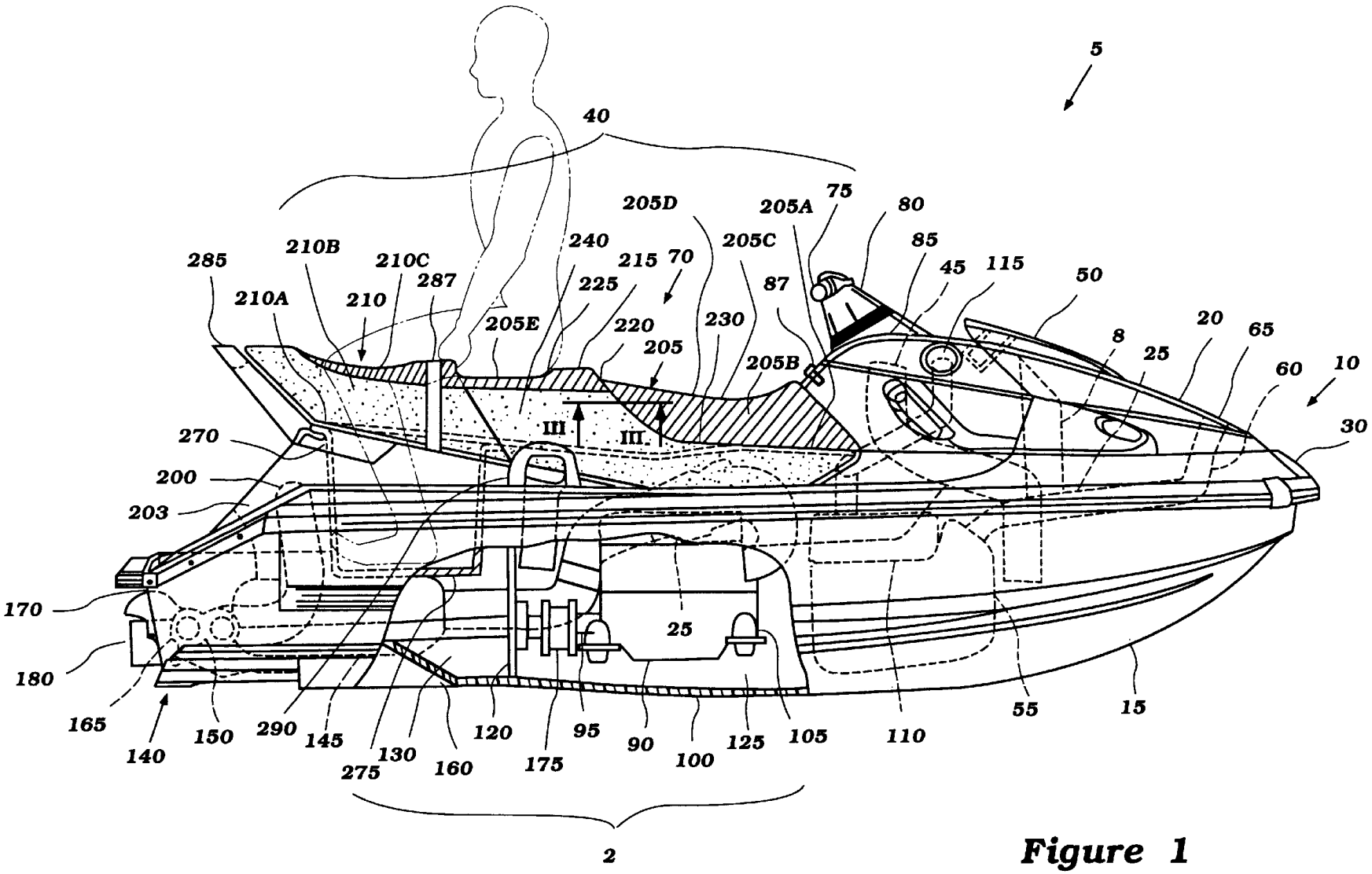
FIG. 1 is a partial sectional, side elevational view of an embodiment of the present invention, partially broken away to show a section of the engine compartment, with several other internal components of the watercraft illustrated in phantom.
Figure 2:
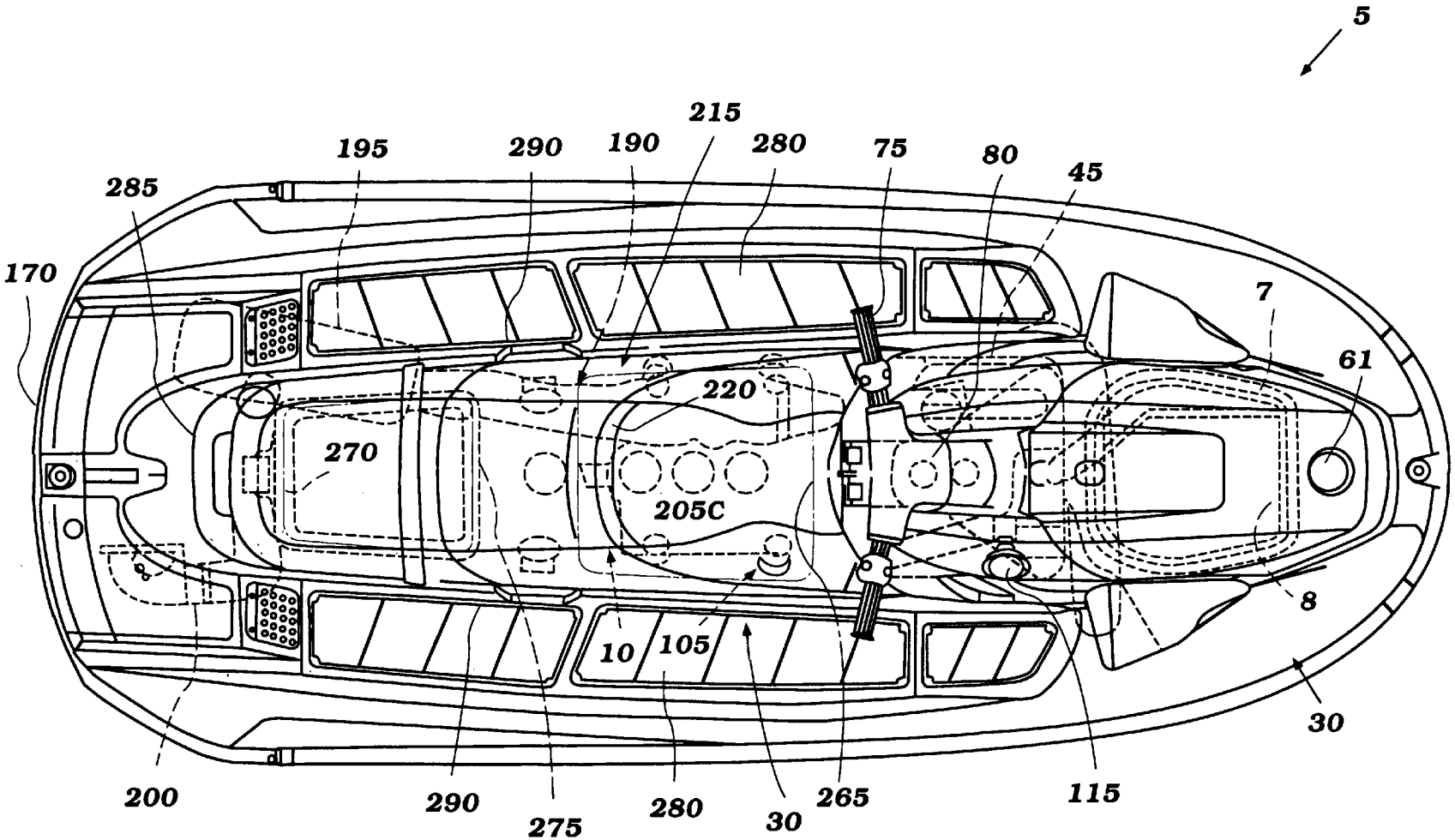
FIG. 2 is a top plan view of the small watercraft of FIG. 1, with several internal components of the watercraft illustrated in phantom.
Figure 3:
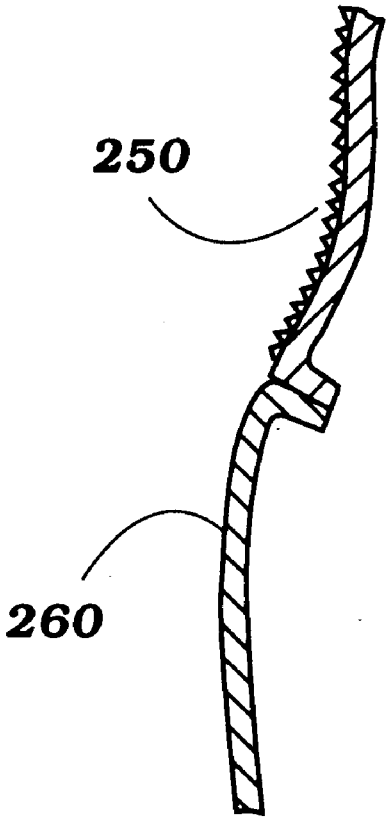
FIG. 3 is a cross-sectional view of the material covering the seat of the watercraft, taken along line III.

FIGS. 1 and 2 illustrate a small watercraft incorporating a seat configured in accordance with a preferred embodiment of the present invention. While the present seat arrangement has particular utility with a seat assembly in which occupants of the small watercraft ride tandem, the present invention may also be utilized on small watercraft that incorporate other seat arrangements, such as side-by-side seating. As such, the seat assembly has particular utility in connection with personal watercraft, and the following will describe the present seat assembly in this context; however, it is understood that the seat assembly can also be employed on other types of watercraft.

With initial reference to FIGS. 1 and 2, a small watercraft, indicated generally by reference numeral 5, includes a hull 10 formed by a lower hull section 15 and upper deck an section 20. These hull sections 15, 20 are formed from a suitable material such as, for example, a molded fiberglass reinforced resin. The lower hull section 15 and the upper deck section 20 are fixed to each other around the peripheral edges 25 in any suitable manner commonly known to those skilled in the art.

As viewed in a direction from the bow to the stem of the watercraft, the upper deck section 20 includes a bow portion 30, a control mast 35 and a rider's area 40. The bow portion 30 slopes upwardly toward the control mast 35 and includes at least one air duct 45 through which air can enter the hull 10. A lid or cover 50 desirably extends above an upper end of the air duct 45 to inhibit an influx of water into the hull 10.

The control mast 35 extends upward from the bow portion 30 and supports a handlebar assembly 75. The handlebar assembly 75 controls the steering of the watercraft in a conventional manner well known to those skilled in the art. The handlebar assembly also carries a variety of the controls of the watercraft such as, for example, a throttle control, a start switch and a lanyard switch. The handlebar assembly 75 is enclosed by a handle cover 80 and is pivotally provided in front of the seat 70.

The seat 70, which will be described in detail below, is provided in the rider's area 40. The seat 70 desirably is a straddle-type seat having an elongated shape and extends along the longitudinal axis of the watercraft. Thus, the seat is centrally located between the sides of the hull.

A hatch cover 85 is provided in front of the steering handle 75. The hatch cover 85 is able to open and close freely, thereby exposing the forward section of the interior of the hull 10. A latch 87 is provided to secure the hatch cover 85 in its closed position during operation of the watercraft 5. A storage box 8 is removably provided in the deck below the hatch cover 85. This storage box 8 is covered by the hatch cover in a water sealing manner.

As illustrated in phantom in FIGS. 1 and 2, a fuel tank 55 is located within the hull 10. A fuel filler hose 60 extends from the surface of the deck 20 to the fuel tank 55. Conventional means such as straps (not shown) secure the fuel tank to the lower hull 15. In the illustrated embodiment, a filler cap assembly 65 is secured to the bow portion 30 of the hull upper deck 20. In this manner, the fuel tank 55 may be filled from outside the hull 10 with the fuel passing through the fuel filler hose 60 into the tank 55.

An oil tank 110 is provided above the fuel tank 55. An oil filler port 115 of the oil tank 110 is provided on the upper deck 20 to the side and in front of the control mast 35.

An in-line, three-cylinder, two-cycle crankcase compression engine 90 is mounted in the center of the main body of the watercraft; however, other types of engines also can be used to power the watercraft. For instance, engines with other numbers of cylinders, with other cylinder arrangements and which operate on other operating principles (e.g., four-stroke) can be used for this purpose.

The engine 90 desirably is oriented within the hull 10 to locate a crankshaft 95 of the engine 90 along a longitudinal axis of the main body. The engine 90 is mounted above the bottom 100 of the watercraft through a damper member or mount 105.

A bulkhead 120 desirably is vertically provided behind the engine 90 and divides the main body 2 into an engine chamber or compartment 125 and a propulsion chamber 130. Air ducts 45 for guiding air into the engine chamber 125 are provided in the forward/rear parts of the engine chamber. Air inlet ports of each air duct 45 are connected to openings formed in the low portion 30. Outlet ports of each air duct 45 are respectively opened to the rear side of the engine and forward side of the fuel tank 55. Although air is supplied to the engine compartment 125 though both ducts, a flow of air from the front duct to the rear duct also occurs to air cool the engine and the other components of the watercraft located in the engine compartment 125.

A jet propulsion unit, indicated generally by reference numeral 140, is provided in the propulsion chamber 130. This jet propulsion unit 140 includes a propulsion shaft 145 to which an impeller (not shown) is fixed. The impeller shaft 145 is positioned in the forward/rear directions and extends through an intake duct 150 that has a water inlet port 160 positioned on the keel of the hull bottom 100. The lower hull section 15 includes an opening at the stem 170 of the watercraft 5 in which an outlet nozzle 165 of the propulsion unit 140 is positioned. A front end of the propulsion shaft 145 and crankshaft 95 of the engine are coupled through a coupling 175 to transfer force from the crankshaft to the propulsion shaft. The propulsion unit 140 generates the propulsive force by applying pressure to water drawn up from the water inlet port 160 by means of the rotation of the propulsion shaft 145, and forcing the pressurized water through the outlet nozzle 165 in a manner well known to those skilled in the art.

A nozzle deflector or steering nozzle 180 is connected to the outlet port 165 of the propulsion unit 140. The nozzle deflector 180 desirably moves in the left/right and vertical directions via a known gimbal mechanism. The nozzle deflector 180 is connected to the steering handle 75 through a steering mechanism and trim mechanism (not shown), whereby the steering and trim angles may be changed by the operation of the steering handle 75 and associated trim controls.

On one side of the engine 90, an intake system (not shown) is provided. On the other side of the engine 90 the exhaust system is provided. In the exhaust system, an exhaust pipe 190 extends from the front side of the engine and bends to the rear direction. A downstream end of the exhaust pipe 190 is connected through a front end of a water lock or trap 195. The water lock 195 is provided on one side of the propulsion chamber 130, whereby the water lock 195 inhibits a reverse flow of water toward the engine. In the rear end of the water lock 195, a through-hull exhaust pipe 200 is connected. This exhaust pipe 200 extends upwardly and across the hull and over the pump chamber, and is connected to a pump chamber of the watercraft to exhaust at this location.

The seat assembly, indicated generally at 70, is divided in forward/rear parts which are attached to a longitudinally extending pedestal 203. The pedestal 203 desirably is formed as part of the upper deck 20.

The seat assembly 70 also desirably includes a first or main seat element 205 for at least two persons and a second or secondary seat element 210 for at least one person. Both seat elements 205, 210 are removably attached to the upper deck 20. In the illustrated embodiment, the secondary seat element 210 can be removed while the main seat 205 remains mounted. The secondary seat element 210 may be fastened to the upper deck 20 by various mechanisms well known by those skilled in the art, such as hinges, latches, snap fasteners, and/or straps, among others. Preferably, the secondary seat element 210 will incorporate at least one hinge-type or other flexible fastener to allow a rider to move the secondary seat element 210 without requiring detachment of the secondary seat element 210 from the watercraft. This would allow the rider to access a storage compartment (described later) without completely removing the secondary seat element 210 from the watercraft 5. When the secondary seat element 210 is removed, a lock lever (not shown) provided in the rear side of the main seat 205 desirably appears, whereby the main seat 205 can be removed by pulling the lever and releasing the lock. Other attachment arrangement, however, are possible where the seat elements 205, 210 can be removed independent of each other.

The main and secondary seat elements 205 and 210 include bottom plates 205*a*, 210*a*, cushions 205*b*, 210*b* and skins 205*c*, 210*c* covering the surface of the cushions 205*b*, 210*b*. In the center of the main seat 205, in the forward/rear directions, a projecting part or protrusion 215 is provided whereby the main seat 205 is divided to a front seat section 205*d* and rear seat section 205*e*. In the disclosed embodiment, the protrusion 215 extends transversely across the main seat 205. A slope 220 is formed in the forward side of the projecting part 215 so as to prevent an operator from sliding to the rear side. Another slope 225 is formed in the rear part of the projecting part 215 so as to prevent a second rider from sliding to the forward side. Each of these sloped sections smoothly rise from the respective seat sections 205*d*, 205*e*, and have a sufficient height to inhibit sliding of the riders on the seat. For instance, the front facing inclined surface 220 has a sufficient height (e.g., at least about an inch) to inhibit sliding of the operator on the seat 70 in the rearward direction. Likewise, the rear facing inclined surface 225 has a sufficient height (e.g., at least about an inch) to inhibit a rear facing rider from sliding forward on the seat 70.

The sloping surfaces 220, 225 desirably are spaced apart from each other along a longitudinal axis of the seat 70. The spacing desirably is sufficiently large to allow for the front facing operator and rear facing passenger to ride on the seat 70 next to each other. In an exemplary embodiment, this distance is at least about two inches.

The exterior surfaces 230, 240 of the main and secondary seat elements 205, 210 desirably are formed of a first skin 230*a*, 240*a* (respectively), forming an upper seat surface to which a rider's buttocks contacts, and a second skin 230*b*, 240*b* (respectively), forming a side surface to which a rider's inner thighs and legs contact. Preferably, the first and second skins are sewn together or are bonded to each other by an adhesive or other means well known to those skilled in the art. On the surface of the first skins 230*a* and 240*a*, delicate crimps or ridges 250 are formed so as to prevent slippage. These delicate ridges 250 on the first skins 230*a* and 240*a* cause the first skins 230*a* and 240*a* to have a generally rough surface that is rougher than the surface of the second skins 230*b* and 240*b*. In the illustrated embodiment, the ridges 250 extend in a transverse direction (i.e., genially normal to the longitudinal axis of the seat 70). This embodiment of the present invention serves to further hold the riders of a small watercraft at their desired location on the seats, yet prevent excessive chafing and discomfort of the unprotected, exposed skin (e.g., thighs and legs of the riders) due to the rough seat surface.

A maintenance opening 265 is formed on the top surface of the seat pedestal 203 and is positioned below the main seat element 205. This maintenance opening 265 is covered by the bottom plate of the main seat 205 in a water sealing manner. The engine chamber 125 can be accessed through this maintenance opening 265 by removing the main seat 205.

An opening 270 is formed in the top surface of the pedestal 203 below the secondary seat element 210. A storage box 275 is removably provided in the opening 270. Preferably, the storage box 275 has a flange (not shown) formed along the exterior of its upper edge, by which it engages and is secured into the opening 270. In the illustrated embodiment, the top of the storage box 275 is covered by the bottom plate of the secondary seat element 210 in a water sealing manner.

A rider may access the hull in the area behind the bulkhead 120 and above propulsion chamber 130 (i.e., the chamber of the hull in which the jet pump unit 140 is located) by opening/removing the secondary seat element 210, and then subsequently removing the storage box 275 from the opening 270. While the rider is performing this operation, the present invention allows the rider to sit on the main seat 205, facing in a rearward direction. Because the rider is seated on the main seat 205 while performing this operation, the watercraft 5 tends to remain most stable in the water, allowing minor maintenance tasks to be performed while the small watercraft is underway.

The position of the opening 270 and the storage box 275 also provides a space for the rear-facing passenger when the secondary seat element 210 is removed. In this position, the rider can place his or her feet directly behind the main seat element 205 in a comfortable position.

The upper deck 20 also includes foot areas 280 formed along side the pedestal 203. The foot areas 280 are formed between the pedestal 203 and a pair of raised side gunnels 283 that extend along the outer sides of the watercraft in the rider's area 40. The foot areas 280 are sized to accommodate the legs and feet of the riders who straddle the seat 70 when seated in a forward facing direction and when at least one rider is seated in a rear facing direction. In the illustrated embodiment, the foot areas merge into a rear deck formed at the rear of the watercraft behind the pedestal. The rear deck extends above the jet unit 140 and allow eased entry into the watercraft 5, as known in the art.

At the rear end of the secondary seat element 210, a grab bar 285 is provided. This grab bar 285 may be used by a third rider to maintain his or her balance while sitting on the secondary seat element 210. A strap 287 is also provided at the front end of the secondary seat element 210. The strap 287 is positioned so as to be used by a forward facing rider seated on the secondary seat element 210, or by a rear facing rider seated on the rear seat section 205*e* of the main seat element 205.

A pair of handles 290 are provided at the rear sides of the main seat 205. These handles 290 may be used by a second rider to maintain his or her balance while sitting on the main seat 205 in either the forward facing or rearward facing directions. Both the handles 290 and the grab bar 285 are secured to the low portion 30 by bolts, or by any other securing method well known to those skilled in the art. The position of the handles 290 generally correspond to the position of the protrusion 215 of the main seat element 205 as viewed in the longitudinal direction.

The seat protrusion, the roughened upper seat skin, and the handles all work together to inhibit unintended movement of the riders on the seat while providing a comfortable seating arrangement for at least one rear facing rider. Of course, a watercraft need not include all of these features to appreciate some of the aforementioned advantages associated with the present watercraft.

Accordingly, although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A small watercraft including an elongated seat for carrying a plurality of riders in the watercraft, said seat comprising a forward seat section located towards a bow of said small watercraft, a rearward seat section located towards a stem of said watercraft, a protrusion extending upwardly between said forward and rearward seat sections, said protrusion having an inclined front surface being located towards said bow and smoothly rising from the forward seat section toward the rear of the watercraft, and an inclined rear surface being located towards said stem, an upper edge of the rear surface being distanced from an upper edge of said front surface along a longitudinal axis of the seat so as to accommodate riders seated on the seat in a back-to-back fashion, said front surface having a sufficient height relative to the forward seat section to inhibit rearward sliding of a forward facing rider seated in the forward seat section of the seat, and said rear surface having a sufficient height relative to the rearward seat section to inhibit forward sliding of a rearward facing rider seated in the rearward seat section of the seat.

2. The watercraft of claim 1, wherein said protrusion extends transversely between sides of the seat.

3. The watercraft of claim 1, additionally comprising foot areas provided alongside said elongated seat, said foot areas extending forward of said rearward seat section to accommodate a rider seated in a forward facing direction in the rearward seat section and extending behind said rearward seat section to accommodate a rider seated in the rearward facing direction in the rearward seat section.

4. The watercraft of claim 1, additionally comprising an upper deck supporting said elongated seat and handles located on said upper deck, said handles arranged at positions proximate a longitudinal position of said protrusion.

5. The watercraft of claim 1, wherein an upper surface of said elongated seat extending between side surfaces of said elongated seat, a first skin covering at least a section of said upper surface, a second skin covering at least a section of said side surfaces, said first skin having a surface roughness greater than a surface roughness of said second skin, whereby said first skin inhibits the movement of a rider relative to said seat.

6. A small watercraft including an elongated seat for carrying a plurality of riders in the watercraft, the seat comprising a forward seat section located toward a bow of the small watercraft, a rearward seat section located toward a stem of the watercraft, a protrusion extending upward between the forward and rearward seat sections, the protrusion having an inclined front surface being located toward the bow and smoothly rising from the forward seat section toward the rear of the watercraft, and an inclined rear surface being located toward the stem and being distanced from the front surface along the longitudinal axis of the seat, the forward surface having a sufficient height relative to the forward seat section to inhibit rearward sliding of a forward facing rider seated in the forward seat section of the seat, the rear surface having a sufficient height relative to the rearward seat section to inhibit forward sliding of a rearward facing rider seated on the rearward seat section of the seat, a first seat element on which at least portions of said forward and rearward seat sections are formed, a second seat element separate from said first seat element, and an upper deck including an opening and supporting said first and second seat elements with at least the second seat element being removably attached to the upper deck, said opening being located underneath said second seat element, whereby the rearward facing rider seated in said rearward seat section may place an extremity into said opening to inhibit motion of said rearward facing rider relative to said opening when said small watercraft is in motion and the second seat element is removed.

7. A small watercraft comprising an upper deck including a seat pedestal and an elongated seat located on top of said seat pedestal, the seat including a forward seat section located towards a bow of said small watercraft and a rearward seat section located towards a stem of said watercraft, the forward and rearward seat sections together defining longitudinally extending sides of the seat, a protrusion extending upwardly between said forward and rearward seat sections, and a plurality of handles attached to said upper deck at a location proximate the longitudinal position of said protrusion, each handle projecting beyond the corresponding side of the seat, whereby a rearward facing rider seated on said rearward seat section may grasp said handles to inhibit motion of said rearward facing rider when said small watercraft is in motion.

8. The small watercraft of claim 7, wherein said handles are attached to said central pedestal.

9. The small watercraft of claim 7, wherein said protrusion has an inclined front surface which smoothly rises from the forward seat section toward said stern, and an inclined rear surface which smoothly rises from the rearward seat section toward said bow, said inclined rear surface being distanced from said inclined front surface along a longitudinal axis of the seat.

10. The small watercraft of claim 7, wherein an upper surface section of said seat extends between side surfaces of said seat, a first skin covers at least a portion of an upper surface of said seat, a second skin covers at least a portion of each side surface of said seat, and said first skin has a surface roughness greater than a surface roughness of said second skin, whereby said first skin inhibits the movement of said rider relative to said seat.

11. The straddle-type seat of claim 10, wherein said second skin generally has a smooth exterior surface.

12. The straddle-type seat of claim 10, wherein said first skin has ridges.

13. The straddle-type seat of claim 12, wherein said ridges are arranged to extend in a direction generally normal to a longitudinal axis of the elongated seat.

14. The small watercraft of claim 10, wherein the protrusion has an inclined front surface which smoothly rises from the forward seat section toward the stern, and an inclined rear surface which smoothly rises from the rearward seat section toward the bow, said inclined rear surface being distanced from said inclined front surface along a longitudinal axis of the seat.

* * * * *

UNITED STATES PATENT AND TRADEMARK OFFICE

CERTIFICATE OF CORRECTION

PATENT NO. : 6,041,732
DATED : March 28, 2000
INVENTOR(S) : Ikeda

It is certified that error appears in the above-identified patent and that said Letters Patent is hereby corrected as shown below:

Column 6,
Line 47, please replace "a stem of" with -- a stern of --
Line 52, please replace "said stem " with -- said stern --

Column 7,
Line 20, please replace "toward a stem of" with -- toward a stern of --
Line 26, please replace "toward the stem " with -- toward the stern --

Signed and Sealed this

Eighth Day of January, 2002

*Attest:*

*Attesting Officer*

JAMES E. ROGAN
*Director of the United States Patent and Trademark Office*